US006138835A

United States Patent [19]

Jessup et al.

[11] Patent Number: 6,138,835

[45] Date of Patent: Oct. 31, 2000

[54] RECOVERY OF PETALITE FROM ORES CONTAINING FELDSPAR MINERALS

[75] Inventors: Timothy Jessup; Srdjan Bulatovic, both of Peterborough, Canada

[73] Assignee: Avalon Ventures Ltd., Toronto, Canada

[21] Appl. No.: 09/350,986

[22] Filed: Jul. 12, 1999

[51] Int. Cl.[7] ..... B03D 1/02; B03D 1/002; B03D 1/01

[52] U.S. Cl. ..... 209/166; 209/167

[58] Field of Search ..... 209/166, 167; 241/24.13, 24.25

[56] References Cited

U.S. PATENT DOCUMENTS

| | | |
|---|---|---|
| 2,748,938 | 6/1956 | Bunge . |
| 2,974,884 | 3/1961 | Martin et al. . |
| 3,859,208 | 1/1975 | Knocke et al. . |
| 4,053,113 | 10/1977 | Rosenstock et al. . |
| 4,098,687 | 7/1978 | Yang . |
| 4,246,096 | 1/1981 | Bulatovic . |
| 4,436,617 | 3/1984 | Moore et al. . |
| 4,600,505 | 7/1986 | Mair et al. . |
| 4,735,710 | 4/1988 | Bulatovic . |
| 4,735,783 | 4/1988 | Bulatovic . |
| 4,772,382 | 9/1988 | Bulatovic . |
| 4,877,517 | 10/1989 | Bulatovic et al. . |
| 4,880,529 | 11/1989 | Bulatovic et al. . |
| 4,952,329 | 8/1990 | Bulatovic et al. . |
| 5,049,612 | 9/1991 | Bulatovic et al. . |
| 5,147,528 | 9/1992 | Bulatovic . |
| 5,338,337 | 8/1994 | Johnson et al. . |
| 5,693,692 | 12/1997 | Bulatovic et al. . |
| 5,879,542 | 3/1999 | Hoecker . |

OTHER PUBLICATIONS

Handbook of Silicote Flotation "Petalite" R.N. Manser; Warren Spring Laboratory Stevenage, Herts, 1993.

"Flotation of petalite from pegmatite rock" M.T. Lyyra; H.R. Laapas; K.G.H. Heiskanen; Department of Materials Science and Rock Engineering, Helsinki University of Technology; A.I. Roitto; Fylharaisio Corporation, Raisio, Finland (1987).

*Concentration of Ores or Rare and Precious Metals*, Nedra 1987, pp. 129–132 (written in Russian).

*Primary Examiner*—Thomas M. Lithgow
*Attorney, Agent, or Firm*—Baker Botts L.L.P.

[57] ABSTRACT

A method for recovering petalite from a mixture comprising petalite and feldspar minerals comprises the steps of forming an aqueous slurry of the mixture and adding to the slurry a depressant selected from the group consisting of alkaline earth metal chlorides, alkali metal chlorides, and mixtures thereof. Next, a collector comprising a quaternary ammonium salt is added to the slurry. The slurry is then subjected to a froth flotation process and petalite that is substantially free of feldspar minerals is selectively recovered from the flotation process.

31 Claims, 1 Drawing Sheet

RECOVERY OF PETALITE FROM ORES CONTAINING FELDSPAR MINERALS

BACKGROUND OF THE INVENTION

1. Field of the Invention

This invention is directed to the recovery of petalite from ores containing feldspar minerals and more specifically to the recovery of petalite from pegmatite ores.

2. Description of Related Art

Petalite is a lithium aluminium silicate mineral (Li, Na), $AlSi_4O_{11}$ or $Li[AlSi_4O_{11}]$ found in a complex type granites, such as pegmatite. Pegmatites may also contain spodumene, mica, feldspars, quartz and other silicates. It is desirable to separate petalites from feldspar-containing cores such as pegmatites, and in doing so, obtain high yields of high purity petalite.

Conventionally, petalite was separated from ores like pegmatites by sorting and heavy media separation. With such conventional methods, however obtaining a high purity petalite concentrate was not possible to achieve. While froth flotation separation is currently used in many ore benefication processes, see, e.g., U.S. Pat. No. 5,147,528 to Bulatovic, herein incorporated by reference, commercial processes for the selective recovery of petalite in high yields have not been successful.

Therefore, a need has arisen for a method of selectively recovering petalite from pegmatite ore that overcomes the disadvantages and deficiencies of the prior art.

SUMMARY OF THE INVENTION

In accordance with a principle aspect of the present invention, it is a technical advantage of the present invention to provide a method for recovery of petalite from pegmatite ores.

The present invention provides for treating complex pegmatite ores containing mica, spodumene, sodium and/or potassium feldspars, quartz, and the like, which includes using a froth flotation process to selectively recover petalite in high yields.

These and other technical advantages are provided through one or more of the following embodiments. In one embodiment, a method for recovering petalite from a mixture comprising petalite and feldspar minerals comprises the steps of: a) forming an aqueous slurry of the mixture; b) adding a depressant selected from the group consisting of alkaline earth metal chlorides, alkali metal chlorides, and mixtures thereof, to the slurry; c) adding a collector comprising a quaternary ammonium salt, to the slurry; d) subjecting the slurry to a froth flotation process; and e) selectively recovering petalite substantially free of feldspar minerals from the flotation process.

In another embodiment, a method for recovering petalite from a pegmatite ore comprises the steps of: a) forming an aqueous slurry of the pegmatite ore, wherein the pegmatite ore comprises petalite, feldspars, mica , and spodumene; b) selectively recovering mica from the slurry using a first froth flotation process; c) selectively recovering spodumene from the slurry using a second froth flotation process; d) adding a depressant selected from the group consisting of alkaline earth metal chlorides, alkali metal chlorides, and mixtures thereof, to the slurry; e) adding a collector comprising a quaternary ammonium salt to the slurry; f) subjecting the slurry to a third froth flotation process; and g) selectively recovering petalite substantially free of feldspar minerals from the third flotation process.

Other objects and advantages of the invention are set forth in part in the description which follows, and in part, will be apparent from this description, or may be learned from the practice of the invention.

BRIEF DESCRIPTION OF THE DRAWINGS

For a more complete explanation of the present invention and the technical advantages thereof, reference is now made to the following description and the accompanying drawing, in which.

DETAILED DESCRIPTION OF THE EMBODIMENTS

Figure 1:
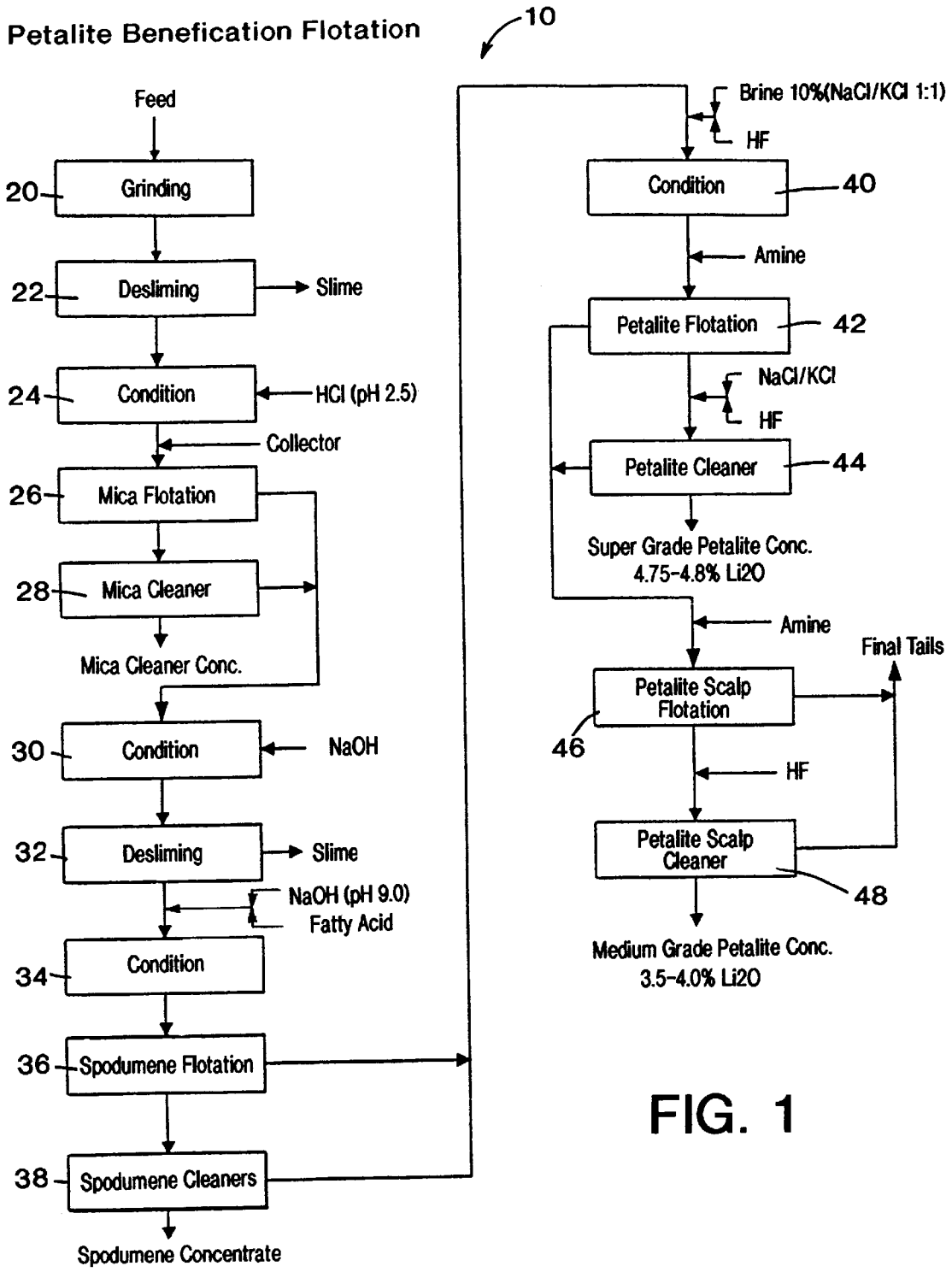
FIG. 1 illustrates a flow chart of the process of the present invention.

Embodiments of the present invention and their technical advantages may be better understood by referring to FIG. 1.

The present invention provides a method for recovery of petalite from ores containing feldspars (K, Na, and the like). While the present invention may be used for recovering petalite from any complex ores that contain petalite and feldspars, the present invention is preferably used to recover petalite from pegmatite ores and will be described below in terms of these materials.

In a preferred embodiment, the present invention employs a froth flotation process to recover petalite from complex pegmatite ores that contain mica, spodumene, feldspars, quartz and other silicates and aluminosilicates minerals, and tantalum, tin, niobium, oxides, iron oxides, and the like. As stated above, Petalite is a lithium aluminium silicate mineral with theoretical $Li_2O$ grade of 4.89 and hardness of 6.0–6.5 (Mohs scale)

Flotation is a separation technique based on the use of chemical reagents to modify the surface properties of different constituents to permit them to be separated. The steps for preparing an ore for flotation varies according to the type of ore, however, generally, first the ore is reduced in size, by either dry or wet grinding, to liberate the valuable minerals and the gangue minerals from each other. The ground ore is then slurried with water. The ore may then be deslimed to remove ultrafine slimes which normally interfere with flotation.

Next, the ore is preconditioned stepwise with a modifier, activator, and/or a depressant. The modifier creates a desired pH in the slurry to provide for the most favorable separation conditions. The activator creates improved conditions for absorption of the collector on the mineral surface. Depressants are used to make certain minerals wettable with water; these are usually minerals from which valuable minerals are separated.

After preconditioning, a collector is added to the slurry. The collector makes the valuable minerals non-wettable with water (e.g., hydrophobic). After an appropriate collector-slurry contact time, such as one to ten minutes, the slurry is fed to a flotation device through which air is passed. These conditions, known as froth flotation, create air bubbles on which hydrophobic valuable minerals attach and are carried into the froth phase. The valuable minerals are then either removed by free flow or mechanical devices.

For flotation of silicates and aluminosilicates, anionic and cationic collectors have been used. Usually with these types of collectors, certain modifiers, depressant and/or activators should be used. Modifiers that may be used are, for example, $H_2SO_4$, soda ash, sodium hydroxide, and the like. Depressants that may be used are, for example, sodium silicate, HF, and the like.

Collector types useful for flotation of silicates and aluminosilicates include: (i) primary amine collectors ($RNH_2$) such as coco amine, acetate tallowalkyl amine, or oleyl amine, which are suitable collectors for mica flotation from other silicates at acid pH. (ii) Quaternary ammonium salts $RN^+(CH_3)_3$ Cl, which are collectors that may be used if the electrical charge properties of the mineral surfaces are important. These collectors are used for flotation of certain silicates from calcite. There is a relatively large number of these collectors and they differ from each other in carbon chain length (R) and the sources from which they are produced. (iii) Anionic collectors, such as tall oil fatty acids, which may be used for flotation of spodumene [lithium silicate ($LiAl(Si_2O_6)$)] in alkaline pH. These collectors are not suitable for use in petalite flotation processes or with some other lithium containing ores. (iv) Primary aminoacetates, which may be used for flotation of feldspar after activation with a fluorite ion, such as hydrofluoric acid (HF), but which do not selectively float petalite.

In one embodiment of the present invention, before the flotation of petalite is commenced, mica and spodumene are separately floated ahead of the petalite flotation using conventional flotation processes. The present invention uses a brine depressant and a quaternary ammonium salt collector for froth flotation of petalite. The brine depressant may contain a high concentration of NaCl, KCl, or a mixture of NaCl and KCl. Alternatively, any alkaline earth metal chloride, alkali metal chloride, or mixtures thereof may be used as the brine. For example, barium chloride may be used.

According to FIG. 1, a mineral separation flowsheet 10 is shown, which includes the petalite flotation process of the present invention. Preferred pre-treatment includes steps 20 to 38. In grinding step 20, the ore, which may contain mica, spodumene, petalite, feldspar, quartz or other silicates and aluminosilicates, is stage wet ground to liberation size. Liberation size may be between $K_{80}$=80 microns and $K_{80}$=180 microns, however liberation size may vary depending on the nature of the ore and the generic type of the ore. Various grinding techniques may be used that are conventionally known in the art.

After being ground at step 20, the ore is deslimed in step 22 to remove ultrafine slimes, for example slimes that are approximately 10 microns. The liberation of the ore occurs between $K_{80}$=120 microns to $K_{80}$=250 microns. The deslimed slurry is preconditioned at step 24 with hydrochloric acid (HCl), to bring the slurry to a pH of approximately 2.5. The slurry is then sent through a conventional mica flotation step at step 26, using a cationic collector. Suitable cationic collectors include amino salts, such as Tallowalkyl acetates. For example, an amines that may be used include ARMAC® T or ARMAC® C (registered trademarks of Akzona, Inc.). Alternatively, other processes for recovering mica or removing mica as an unwanted impurity, may be used.

After the mica flotation step 26, the resulting slurry (mica tailing) is preconditioned with an alkaline modifier at step 30, such as in the pH range from 8.0 to 10.5. Suitable modifiers known in the art include is sodium hydroxide (NaOH). The resulting pulp may then be deslimed at step 32. Desliming removes the liquid which contains the collector from mica flotation step 26. Removing the collector may prevent interference by the collector in subsequent flotation steps. After desliming step 32, the deslimed slurry may be conditioned in step 34. The slurry is repulped with water to make a resulting slurry of preferably approximately 35% solids and then preconditioned with an alkaline modifier, such as NaOH, to create a pH between 8.5 to 10.5. Preferably, the resulting pH is between 8.5 and 9.0. The alkaline modifier may alternatively be soda ash or some other suitable alkaline modifier. After preconditioning with an alkaline modifier at step 34, a tall oil fatty acid (anionic collector) is added and spodumene is then floated at step 36. Any known method for spodumene flotation, which is used to recover spodumene, may be used. The resulting tailing (or slurry) from spodumene flotation step 36 contains petalite, feldspars and other silicates and is processed according to the process of the present invention, At step 40, a depressant, such as brine, is added. Preferably, a brine derived from the mixture of sodium chloride (NaCl) and potassium chloride KCl (1:1) ratio, is used. The ratio of Na to K in the brine can be varied depending on the amount of soda and potash feldspar present in the slurry. In addition, in a preferred embodiment, hydrofluoric acid (HF) is also used as an activator for petalite and also for depressant for quartz. Thus, the thickened tailings from the spodumene flotation stage are stepwise conditioned with brine and HF.

The preferred brine concentration in the slurry is about 10% by weight, however somewhat lower or higher levels may be used without significant effect on the petalite flotation, such as between 3% and 10%. If a low grade petalite is acceptable, the concentration of brine used may be reduced. However, to achieve a high grade petalite, the preferred concentration of brine should be employed. Conditioning step 40 is carried out for a time sufficient to condition the slurry and typically lasts about 5 minutes, but a somewhat longer period may be used. Additionally, conditioning step 40 is preferably carried out at a pH of between 2.0 and 3.0, controlled by both additions of HF and sulphuric acid. More preferably, the pH is 2.5. A lower or higher pH is less preferable, because the efficiency of petalite flotation tends to decrease. In step 40, the brine and HF may be added together, but also may be added separately in individual steps.

After preconditioning with brine, a collector may be added. The preferable collector is a quaternary ammonium salt. Compounds such as decyl, alkyl dodecyl, and dioctadecyl quaternary ammonium salts are collectors that may be used for flotation of petalite in the presence of brine solution. Ethoxylated quaternary salts and propoxylated quaternary salts are also suitable collectors. Conditioning with the collector may last for a time sufficient to condition the slurry, typically about two minutes. The collector is most beneficial when added in the range of about 250–400 gr/t; however, somewhat higher or lower levels of collector may be employed, depending on the fineness of grind as well as on the ore composition.

The collector conditioning is followed by flotation which is preferably carried out in two distinct stages 42 and 46. The first stage of flotation 42 is conducted for a time sufficient, after cleaning step 44, to produce a super grade petalite concentrate with a purity of preferably between 4.7% and 4.8% $Li_2O$. Typically flotation times are in the range of from about 4–10 minutes. The rougher concentrate is cleaned at step 44 once or twice to achieve a high purity petalite concentrate.

The second flotation step 46 is conducted on combined tailing products from the first step 42 with extra additions of the collector. The level of collector added in this stage is typically between 10–50 gr/t, but may be somewhat higher or lower depending on the desired petalite yield.

This second step, or scalp step, 46 is designed to produce medium grade petalite concentrate which can vary between 2.7% and 4% $Li_2O$, and more preferably between 3.5% and 4.0% $Li_2O$.

The tailing from the petalite circuit (i.e. recovery stage) can be used for recovery of soda and potash feldspar which are also valuable market commodities.

Adding brine in the petalite recovery step provides a high degree of separation between petalite and feldspar minerals such as albite and microcline.

The present invention may alternatively be used to selectively recover petalite from aluminosilicate ores other than pegmatite, especially those containing feldspar minerals.

In the present invention, HF may be added at steps 44 or 48 to act as both a petalite activator and a selectivity assisting agent. Further, quaternary ammonium based compounds may be added at steps 42 and 46 as suitable collectors to assist in the recovery of petalite, however, the present invention also operates with other products of a similar chemical composition. Additionally, a brine derived from the mixture of sodium chloride (NaCl) and potassium chloride (KCl), may be added at step 44 to assist in petalite recovery.

EXAMPLES

The invention will be further clarified by a consideration of the following examples, which are intended to be purely exemplary of the use of the invention.

Example 1

Laboratory separation tests were conducted on a pegmatite ore of complex nature using conventional reagents, such as described in Polkin C. I., *Concentration of Ores or Rare and Precious Metals*, Nedra 1987, at 115–153, herein incorporated reference (hereinafter "Polkin"). The reagent additions are described in Table 1. The ore was obtained from the Big Whopper pegmatite deposit on the Separation Rapids property near Kenora, Ontario, Canada. The ore was ground to about 48 mesh. First sequential flotation of mica and spodumene were conducted using conventional processes. The petalite flotation was attempted from the spodumene tailing. For petalite flotation, the pulp was preconditioned with HF and then with sodium oleate followed by petalite flotation. The reagents used in the respective amounts, together with the results obtained, are shown in Table 2. As can be seen from the results, good separations were obtained by mica and spodumene flotation, but petalite did not float as well with the anionic collector.

TABLE 1

| Reagent Additions | | | |
|---|---|---|---|
| | Addition grams per tonne | | |
| Reagent | Mica Flotation | Spodumene Flotation | Petalite Flotation |
| HCL | 450 | — | — |
| ARMAC ® T[1] | 150 | — | — |
| NaOH | — | 400 | — |
| Tall oil D40LR[2] | — | 1000 | — |
| HF | — | — | 200 |
| $H_2SO_4$ | — | — | — |
| Sodium Oleate | — | — | 2000 |

[1]Primary Amine
[2]Anionic collectors. Tall oil with high Rosin acid

TABLE 2

| Metallurgical Results | | | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Mica Conc. | 8.06 | 2.51 | 27.5 | 8.38 | 0.93 | 10.9 | 13.8 | 26.7 | 2.2 |
| Spodumene Conc. | 6.71 | 5.75 | 20.6 | 0.83 | 0.45 | 20.8 | 8.6 | 2.2 | 0.9 |
| Petalite Conc. | 10.40 | 2.34 | 15.1 | 1.79 | 3.24 | 13.9 | 9.8 | 7.4 | 10.1 |
| Petalite Tail | 68.20 | 1.35 | 14.3 | 2.08 | 3.91 | 49.7 | 60.7 | 56.0 | 79.5 |
| Slimes | 6.58 | 1.49 | 17.3 | 3.00 | 3.70 | 5.3 | 7.1 | 7.8 | 7.3 |
| Feed | 100.00 | 1.85 | 16.1 | 2.53 | 3.35 | 100.0 | 100.0 | 100.0 | 100.0 |

Example 2

The same pegmatite ore as in Example 1 was used in Example 2, to test the claim from "Polkin" that petalite was readily e floatable using a cationic collector. The cationic collator used in this example was ARMOFLOTE® 65 (a registered trademark of Akzona, Inc.), which is a modified dodecy/amine. The quantities of reagent is shown in Table 3 and the results obtained are shown in Table 4. The results demonstrated that petalite flotation was less efficient using a cationic collector which was comprised of primary amine.

TABLE 3

| Reagent Additions | | | |
|---|---|---|---|
| | Addition grams per tonne | | |
| Reagent | Mica Flotation | Spodumene Flotation | Petalite Flotation |
| HCL | 400 | — | — |
| ARMAC ® T | 150 | — | — |
| NaOH | — | 400 | — |
| Tall oil D40LR | — | 1000 | — |
| HF | — | — | 300 |
| $H_2SO_4$ | — | — | 600 |
| Armoflote 64 | — | — | 800 |

TABLE 4

| Metallurgical Results | | | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Mica Conc. | 7.03 | 2.52 | 26.9 | 8.02 | 1.16 | 9.5 | 12.1 | 24.4 | 2.4 |
| Spodumene | 5.76 | 5.48 | 20.4 | 0.89 | 0.45 | 17.0 | 7.5 | 2.2 | 0.8 |
| Conc. Petalite | 11.96 | 0.69 | 15.9 | 4.32 | 4.12 | 4.4 | 12.2 | 22.3 | 14.6 |
| Conc. Petalite | 32.16 | 1.07 | 14.13 | 2.63 | 3.96 | 18.6 | 29.1 | 36.6 | 37.7 |
| Rough Conc. Petalite | 48.47 | 1.90 | 14.2 | 1.35 | 3.62 | 49.6 | 44.1 | 28.3 | 51.9 |
| Tail Slimes | 6.58 | 1.49 | 16.7 | 2.98 | 3.66 | 5.3 | 7.0 | 8.5 | 7.1 |
| Feed | 100.00 | 1.85 | 15.6 | 2.31 | 3.38 | 100.0 | 100.0 | 100.0 | 100.0 |

Example 3

Laboratory experimental tests were carried out under similar conditions as in Example 2 but using quaternary ammonium salt as a collector for petalite as described in *Flotation of Petalite from Pegmatite Rock*, by M. T. Lyyra, H. R. Laapas, K. G. H. Hesikanen, and A. I. Roitto, Ins. of Min. and Metoal (1987), pages 361 to 365, herein incorporated by reference. The reagents used are shown in Table 5 and the results obtained are shown in Table 6. Under these conditions petalite was floated, but together with feldspar. As can be seen from the results, about 85% of the soda feldspar was reported in the petalite rougher concentrate. As a result low grade petalite concentrate was produced.

TABLE 5

| Reagent Additions | | | |
|---|---|---|---|
| | Addition grams per tonne | | |
| Reagent | Mica Flotation | Spodumene Flotation | Petalite Flotation |
| HCL | 450 | — | — |
| ARMAC ® T | 150 | — | — |
| NaOH | — | 400 | — |
| Tall oil D40LR | — | 1000 | — |
| HF | — | — | 1000 |
| $H_2SO_4$ | — | — | 100 |
| NaCl | — | — | 3000 |
| MG93[3] | — | — | 300 |

[3]Quaternary Ammonium Salt

TABLE 6

| Metallurgical Results | | | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Mica Conc. | 9.63 | 2.17 | 26.90 | 7.91 | 1.08 | 12.4 | 16.3 | 30.4 | 2.9 |
| Spodumene Conc. | 4.86 | 4.52 | 22.50 | 1.91 | 0.51 | 13.0 | 6.9 | 3.7 | 0.7 |
| Petalite | 22.44 | 3.27 | 17.3 | 0.83 | 3.13 | 43.3 | 24.4 | 7.4 | 19.8 |
| Clean Conc. Petalite | 60.61 | 1.72 | 16.8 | 2.11 | 4.96 | 61.6 | 64.4 | 51.1 | 85.1 |

TABLE 6-continued

| | | Metallurgical Results | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Rough Conc. Petalite | 22.49 | 0.81 | 7.0 | 1.36 | 1.41 | 10.8 | 10.0 | 12.2 | 9.0 |
| Rough Tail Slimes | 2.40 | 1.63 | 16.1 | 2.73 | 3.30 | 2.3 | 2.4 | 2.7 | 2.2 |
| Feed | 100.00 | 1.69 | 15.9 | 2.51 | 3.30 | 100.0 | 100.0 | 100.0 | 100.0 |

Example 4

In these experiments the conditions used in Example 3 were applied but with the use of brine in the petalite flotations. The brine used in these experiments was a mixture of NaCl/KCl (1:1) ratio. The slurry was treated with 10% concentration of brine before a quaternary ammonium salt collector was added. In this particular experiment the HF was added together with brine. The reagents used are shown in Table 7 and the results obtained are shown in Table 8.

TABLE 7

| | Reagent Additions | | |
|---|---|---|---|
| | Addition grams per tonne | | |
| Reagent | Mica Flotation | Spodumene Flotation | Petalite Flotation |
| HCL | 450 | — | — |
| ARMAC ® T | 150 | — | — |
| NaOH | — | 400 | — |
| Tall oil D40LR | — | 1000 | — |
| HF | — | — | 1000 |
| $H_2SO_4$ | — | — | — |
| NaCl/KCl brine (1:1) | — | — | 10% |
| MG93 | — | — | 250 |

TABLE 8

| | | Metallurgical Results | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Mica Conc. | 12.41 | 2.07 | 25.3 | 6.98 | 1.85 | 15.9 | 19.7 | 33.5 | 6.3 |
| Spodumene Conc. | 8.52 | 4.66 | 19.9 | 0.48 | 0.63 | 24.4 | 10.7 | 1.6 | 1.5 |
| High Grade Petalite Clean Conc. | 9.40 | 4.41 | 16.8 | 0.35 | 0.65 | 25.5 | 9.9 | 1.3 | 2.0 |
| High Grade Petalite Rough Conc. | 11.23 | 4.29 | 16.7 | 0.43 | 0.80 | 29.6 | 11.8 | 1.91 | 2.1 |
| Low Grade Petalite Clean Conc. | 8.68 | 2.63 | 16.6 | 1.23 | 3.51 | 14.0 | 9.0 | 4.1 | 8.3 |
| Low Grade Petalite Rough Conc. | 17.41 | 1.64 | 13.9 | 1.65 | 3.85 | 17.5 | 15.1 | 11.1 | 18.2 |
| Petalite Rough Tail | 45.15 | 0.27 | 13.1 | 2.68 | 5.38 | 7.5 | 37.1 | 46.7 | 66.5 |
| Slimes | 5.27 | 1.69 | 16.5 | 2.63 | 3.41 | 5.5 | 5.5 | 5.4 | 4.9 |
| Feed | 100.00 | 1.63 | 15.9 | 2.59 | 3.66 | 100.0 | 100.0 | 100.0 | 100.0 |

By comparing the results from Example 4 with Example 3, a dramatic improvement in petalite concentrate grade and selectivity towards feldspar occurred when the brine was used. In Example 4 only 26% of $Na_2O$ was recovered in a petalite rougher concentrate compared with 85% in Example 3.

Example 5

Another sample of the same pegmatite ore, but with lower spodumene content and higher mica content, was used in separation tests employing the reagent and method as in Example 3. The reagent additions used are shown in Table 9 and the metallurgical results are shown in Table 10.

As shown in Table 10 the petalite separation is poor, and the results were similar to these obtained in Example 3. Again, poor selectivity between petalite and feldspar was shown.

TABLE 9

| Reagent Additions | | | |
|---|---|---|---|
| | Addition grams per tonne | | |
| Reagent | Mica Flotation | Spodumene Flotation | Petalite Flotation |
| HCL | 450 | — | — |
| ARMAC ® T | 150 | — | — |
| NaOH | — | 400 | — |
| Tall oil D40LR | — | 1000 | — |
| HF | — | — | 1000 |
| $H_2SO_4$ | — | — | 100 |
| NaCl | — | — | 2000 |
| MG93 | — | — | 250 |

TABLE 10

| Metallurgical Results | | | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Mica Conc. | 15.76 | 1.95 | 24.1 | 5.97 | 2.55 | 20.6 | 24.3 | 38.2 | 10.6 |
| Spodumene Conc. | 3.68 | 3.40 | 17.5 | 0.42 | 0.85 | 8.4 | 4.1 | 0.6 | 0.8 |
| Petalite Clean Conc. | 18.26 | 3.44 | 17.20 | 0.55 | 2.78 | 42.1 | 20.1 | 4.1 | 13.4 |
| Petalite Rough Conc. | 52.46 | 1.60 | 16.60 | 2.04 | 5.22 | 56.1 | 55.6 | 43.4 | 72.1 |
| Petalite Rough Tail | 15.45 | 0.18 | 3.43 | 0.84 | 1.05 | 1.9 | 3.4 | 5.3 | 4.3 |
| Slimes | 12.64 | 1.54 | 15.7 | 2.45 | 3.65 | 13.0 | 12.7 | 12.6 | 12.2 |
| Feed | 100.00 | 1.49 | 15.7 | 2.47 | 3.79 | 100.0 | 100.0 | 100.0 | 100.0 |

Example 6

The same ore sample as used in Example 5 was used in separation tests employing the reagents and method of the present invention. In the petalite flotation stage, brine was used as it was in Example 4. The reagent additions are shown in Table 11 and the metallurgical results are shown in Table 12. The substantial improvement achieved by the use of brine in petalite flotation of the present invention is clearly demonstrated. In the high grade petalite concentrate almost theoretical grade (>98% purity) was achieved compared with the petalite grade of 3.44% $Li_2O$ achieved in Example 5, without the use of brine.

TABLE 11

| Reagent Additions | | | |
|---|---|---|---|
| | Addition grams per tonne | | |
| Reagent | Mica Flotation | Spodumene Flotation | Petalite Flotation |
| HCL | 450 | — | — |
| ARMAC ® T | 150 | — | — |
| NaOH | — | 400 | — |
| Tall oil D40LR | — | 1000 | — |
| HF | — | — | 1000 |
| $H_2SO_4$ | — | — | — |
| NaCl/KCl brine (1:1) | — | — | 10% |
| MG93 | — | — | 250 |

TABLE 12

| Metallurgical Results | | | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Mica Conc. | 15.91 | 2.04 | 24.4 | 6.17 | 2.23 | 21.8 | 24.4 | 39.1 | 9.0 |
| Spodumene Conc. | 3.01 | 4.02 | 21.3 | 0.40 | 0.48 | 8.1 | 4.0 | 0.5 | 0.4 |
| High Grade Petalite Clean Conc. | 8.53 | 4.73 | 16.7 | 0.22 | 0.27 | 27.0 | 8.9 | 0.7 | 0.6 |
| High Grade Petalite Rough Conc. | 10.57 | 4.61 | 16.6 | 0.28 | 0.37 | 32.6 | 11.0 | 1.2 | 1.0 |
| Low Grade Petalite Clean Conc. | 9.27 | 4.01 | 16.8 | 0.36 | 0.57 | 24.9 | 13.6 | 5.5 | 10.1 |
| Low Grade Petalite Rough Conc. | 20.39 | 1.99 | 15.2 | 1.45 | 2.29 | 27.2 | 22.9 | 15.7 | 26.2 |
| Petalite Rough Tail | 46.47 | 0.17 | 12.7 | 2.46 | 5.55 | 5.5 | 34.0 | 40.2 | 60.6 |
| Slimes | 2.70 | 1.74 | 16.3 | 2.54 | 3.03 | 2.9 | 2.6 | 2.5 | 2.0 |
| Feed | 100.00 | 1.53 | 15.8 | 2.57 | 3.78 | 100.0 | 100.0 | 100.0 | 100.0 |

Example 7

A continuous flotation test simulating commercial plant conditions was conducted on the same ore as that from Examples 5 and 6, however, without brine flotation. In such experiments cleaner tailings were recycled back to the flotation stage several times until circuit equilibrium was achieved. The reagents used are shown in Table 13 and the metallurgical results obtained are shown in Table 14. In this particular Example, a low grade concentrate grade was achieved and the concentrate was contaminated with soda and potassium feldspars. In addition about 23% of the total petalite in the ore was lost in the petalite flotation tailing. Therefore both petalite purity and recovery was not satisfactory.

TABLE 13

| Reagent Additions | | | |
|---|---|---|---|
| | Addition grams per tonne | | |
| Reagent | Mica Flotation | Spodumene Flotation | Petalite Flotation |
| HCL | 450 | — | — |
| ARMAC ® T | 150 | — | — |

TABLE 13-continued

| Reagent Additions | | | |
|---|---|---|---|
| | Addition grams per tonne | | |
| Reagent | Mica Flotation | Spodumene Flotation | Petalite Flotation |
| NaOH | — | 400 | — |
| Tall oil D40LR | — | 1000 | — |
| HF | — | — | 1000 |
| $H_2SO_4$ | — | — | — |
| NaCl | — | — | 2000 |
| MG93 | — | — | 250 |

TABLE 14

| Metallurgical Results | | | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Mica Conc. | 10.15 | 2.2 | 26.1 | 7.02 | 1.33 | 8.2 | 16.2 | 27.4 | 3.7 |
| Spodumene Conc. | 2.77 | 5.2 | 21.3 | 0.28 | 0.40 | 9.6 | 3.6 | 0.3 | 0.3 |
| Petalite Conc. | 26.50 | 3.35 | 17.2 | 2.10 | 3.65 | 59.2 | 27.9 | 21.4 | 26.4 |
| Petalite Tailing | 60.58 | 0.57 | 14.1 | 2.18 | 4.21 | 23.0 | 52.3 | 50.9 | 69.6 |
| Feed | 100.00 | 1.50 | 16.3 | 2.60 | 3.67 | 100.0 | 100.0 | 100.0 | 100.0 |

Example 8

In this example, the same ore as used in Example 7 was used and the simulation of the commercial flowsheet was performed. The petalite flotation conditions of Examples 4 and 6 were used. The reagent additions are shown in Table 15 and the metallurgical results for this Example are shown in Table 16. In this Example, high grade petalite concentrate together with low grade concentrate was produced.

TABLE 15

| | Reagent Additions | | |
|---|---|---|---|
| | Addition grams per tonne | | |
| Reagent | Mica Flotation | Spodumene Flotation | Petalite Flotation |
| HCL | 450 | — | — |
| ARMAC ® T | 150 | — | — |
| NaOH | — | 400 | — |
| Tall oil D40LR | — | 1000 | — |
| HF | — | — | 1000 |
| $H_2SO_4$ | — | — | — |
| NaCl/KCl brine (1:1) | — | — | 10% |
| MG93 | — | — | 250 |

TABLE 16

| | | Metallurgical Results | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Mica Conc. | 11.05 | 2.01 | 26.8 | 7.10 | 1.5 | 15.1 | 18.9 | 30.3 | 4.4 |
| Spodumene Conc. | 2.82 | 5.10 | 21.1 | 0.36 | 0.40 | 9.7 | 3.8 | 0.4 | 0.3 |
| High Grade Petalite Conc. | 11.40 | 4.79 | 16.7 | 0.14 | 0.20 | 37.1 | 12.2 | 0.6 | 0.6 |
| Medium Grade | 12.10 | 3.40 | 16.1 | 0.40 | 2.20 | 28.0 | 12.4 | 1.9 | 7.0 |
| Petalite Tailing | 61.64 | 0.24 | 13.4 | 2.80 | 5.39 | 10.1 | 52.7 | 60.8 | 87.7 |
| Feed | 100.00 | 1.47 | 15.6 | 2.59 | 3.78 | 100.0 | 100.0 | 100.0 | 100.0 |

TABLE 17

| | | Metallurgical Results | | | | | | | |
|---|---|---|---|---|---|---|---|---|---|
| | | Assays % | | | | % Distribution | | | |
| Product | WG % | $Li_2O$ | $Al_2O_3$ | $K_2O$ | $Na_2O$ | $Li_2O$ | $Al_2O_3$ | $K_2O$ | $Na_2O$ |
| Mica Conc. | 10.80 | 2.10 | 25.8 | 6.80 | 1.20 | 14.6 | 17.3 | 28.1 | 3.6 |
| Spodumene Conc. | 2.95 | 5.15 | 20.9 | 0.29 | 0.38 | 9.8 | 3.8 | 0.3 | 0.3 |
| Petalite Conc. | 23.66 | 4.42 | 16.8 | 0.20 | 0.30 | 67.5 | 24.7 | 1.9 | 2.2 |
| Petalite Tailing | 62.59 | 0.20 | 13.9 | 2.91 | 5.40 | 8.1 | 54.2 | 69.7 | 93.9 |
| Feed | 100.00 | 1.54 | 16.1 | 2.61 | 3.60 | 100.0 | 100.0 | 100.0 | 100.0 |

Example 9

In this Example, the same ore as used in Example 7 was used and the simulation of the commercial flowsheet was performed. The petalite flotation conditions of Examples 4 and 6 were used. The reagent additions are shown in Table 16 and the metallurgical results for this Example are shown in Table 17. In this Example, high grade petalite concentrate together with low grade concentrate was produced.

In comparing the results from Examples 7, 8 and 9 the high recovery of high grade petalite concentrate with the present invention is clearly demonstrated. It is also demonstrated by Examples 8 and 9 that the process from the present invention can be used in commercial practice. Thus, the present invention demonstrates that super grade petalite concentrations can be produced, which may be used as an important commodity for the glass ceramic industries.

For purposes of clarity of understanding, the foregoing invention has been described in detail by way of illustration and example in conjunction with specific embodiments, although other aspects, advantages and modifications will be apparent to those skilled in the art to which the invention pertains. The foregoing description and examples are intended to illustrate, but not limit the scope of the invention. Modifications of the above-described modes for carrying out the invention that are apparent to persons of skill in the art are intended to be within the scope of the invention, which is limited only by the appended claims.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

We claim:

1. A method for recovering petalite from a mixture comprising petalite and feldspar minerals, said method comprising the steps of:

a) forming an aqueous slurry of said mixture;

b) adding a depressant selected from the group consisting of alkaline earth metal chlorides, alkali metal chlorides, and mixtures thereof, to said slurry, wherein said depressant is in a concentration of 3% or greater;

c) adding a collector comprising a quaternary ammonium salt, to said slurry;

d) subjecting said slurry to a froth flotation process; and e) selectively recovering petalite substantially free of feldspar minerals from said flotation process.

2. The method of claim 1, wherein said mixture is a pegmatite ore.

3. The method of claim 2, further comprising removing mica prior to performing steps (a)–(e).

4. The method of claim 2, further comprising removing spodumene prior to performing steps (a)–(e).

5. The method of claim 2, wherein mica and spodumene are separately removed from said mixture prior to performing steps (a)–(e).

6. The method of claim 1, further comprising:

preconditioning said slurry with hydrofluoric acid prior to step (d).

7. The method of claim 1, wherein said slurry subjected to step (d) has a pH of between 2.0 and 5.0.

8. The method of claim 7, wherein said slurry has a pH of between 2.0 and 3.0.

9. The method of claim 1, wherein said slurry is preconditioned with an alkaline agent prior to step (d).

10. The method of claim 9, wherein said alkaline agent is sodium hydroxide.

11. The method of claim 1, wherein said alkali metal chlorides comprises a mixture of sodium chloride and potassium chloride.

12. The method of claim 11, wherein said mixture of sodium chloride and potassium chloride is present in the ratio of 1:1 by weight.

13. The method of claim 1, wherein said alkali metal chlorides comprises sodium chloride or potassium chloride.

14. The method of claim 1, wherein said depressant is in a concentration of 10% or greater.

15. the method of claim 1 further comprising:

subjecting the tailings from step (e) to a second froth flotation process; and selectively recovering additional petalite substantially free of feldspar minerals from said second flotation process.

16. The method of claim 1, wherein said petalite recovered is from about 3.5 to 5.0% $Li_2O$.

17. The method of claim 1, further comprising:

desliming said slurry of step (a).

18. The method of claim 1, further comprising:

grinding said mixture prior to step (a).

19. The method of claim 18, wherein said mixture is ground to liberation size.

20. The method of claim 1, further comprising:

grinding said mixture prior to step (a); and desliming said slurry of step (a).

21. A method for recovering petalite from a pegmatite ore, said method comprising the steps of:

a) forming an aqueous slurry of said pegmatite ore, wherein said pegmatite ore comprises petalite, feldspars, mica, and spodumene;

b) selectively recovering mica from said slurry using a first froth flotation process;

c) selectively recovering spodumene from said slurry using a second froth flotation process;

d) adding a depressant selected from the group consisting of alkaline earth metal chlorides, alkali metal chlorides, and mixtures thereof, to said slurry, wherein said depressant is in a concentration of 3% or greater;

e) adding a collector comprising a quaternary ammonium salt to said slurry;

f) subjecting said slurry to a third froth flotation process; and g) selectively recovering petalite substantially free of feldspar minerals from said third flotation process.

22. The method of claim 21, further comprising:

preconditioning said slurry with hydrofluoric acid prior to step (b).

23. The method of claim 21, wherein said slurry subjected to step (f) has a pH of between 2.0 and 5.0.

24. The method of claim 21, wherein said slurry is preconditioned with an alkaline agent prior to step (f).

25. The method of claim 21, wherein said depressant is selected from the group consisting of sodium chloride, potassium chloride, and mixtures thereof.

26. The method of claim 21, further comprising:

subjecting the tailings from step (g) to a fourth froth flotation process; and selectively recovering additional petalite substantially free of feldspar minerals from said fourth flotation process.

27. The method of claim 21, wherein said petalite recovered is from about 3.5 to 5.0% $Li_2O$.

28. The method of claim 21, further comprising desliming said slurry of step (a).

29. The method of claim 21, further comprising:

grinding said ore prior to step (a).

30. The method of claim 29, wherein said ore is ground to liberation size.

31. The method of claim 21, further comprising:

grinding said ore prior to step (a); and desliming said slurry of step (a).

* * * * *